United States Patent [19]

Bogner

[11] 4,356,493

[45] * Oct. 26, 1982

[54] DISC-ON-ROD END-FIRE MICROWAVE ANTENNA

[76] Inventor: Richard D. Bogner, 4 Hunters La., Roslyn, N.Y. 11576

[ * ] Notice: The portion of the term of this patent subsequent to Sep. 15, 1998, has been disclaimed.

[21] Appl. No.: 103,614

[22] Filed: Dec. 14, 1979

[51] Int. Cl.[3] ..... H01Q 13/28

[52] U.S. Cl. ..... 343/702; 343/753; 343/785

[58] Field of Search ..... 343/701, 702, 753, 785, 343/819; 455/131, 281, 282, 293

[56] References Cited

U.S. PATENT DOCUMENTS 2,398,096 4/1946 Katzin ..... 343/786

4,290,068 9/1981 Bogner ..... 343/702

*Primary Examiner*—Eli Lieberman

*Attorney, Agent, or Firm*—Leonard H. King

[57] ABSTRACT

A probe excited, open-end waveguide which can be used as an independent antenna, or as a launcher for an end fire, radiator and which achieves higher gain than conventional waveguides without an increase in size. The waveguide is formed as an elongated metallic container which includes a metal structure positioned within the container spaced from the side walls of the container and located within one half of the volume of the container, this volume being defined by cutting the cylinder along its elongated axis. A probe extends from the metal structure for excitation of the waveguide. An electronics package, conventionally utilized in conjunction with the waveguide can be positioned in the container within or under the metal structure. The electronics package does not interfere with the operation of the antenna. The antenna achieves higher gain as a result of the presence of the metal structure. In one embodiment the electronics package comprises a down converter which receives for example a 2 GHz signal containing information, amplifies and then converts it to a signal at a frequency employed by conventional television receivers, i.e. for displaying the information on the receiver.

15 Claims, 12 Drawing Figures

DISC-ON-ROD END-FIRE MICROWAVE ANTENNA

BACKGROUND OF THE INVENTION

This invention relates to antennas, and more particularly to a probe excited waveguide, which can be used as an antenna or as a launcher for an end fire radiator.

Antennas of numerous designs and types are readily available. One such type which has achieved relatively high gain, high directivity over a large frequency band, and has nevertheless been available at low cost, is the disc-on-rod type antenna, excited by a launcher or elementary antenna. Such disc-on-rod type antenna has been described in my prior U.S. Pat. No. 2,955,287, issued on Oct. 4, 1960, and in my U.S. Pat. No. 3,015,821 issued on Jan. 2, 1962. In those patents, both of which are herein incorporated by reference, there is described an end fire radiator having a principal axis adapted to be energized by a launcher at its non radiating end for the transmission of energy of a desired wavelength in the direction of the axis. The electrically active components of the radiator consist of a plurality of substantially identical electrically conductive plates having a major dimension greater than $\lambda/4$ and less than $\lambda/2$ and spaced from each other a distance between $\lambda/8$ and $\lambda/2$, wherein $\lambda$ is the wavelength of the energy. The plane of the plates are normal to the axis to thereby form an elongated radiator.

A further modification of the basic disc-on-rod type of antenna is described in my prior U.S. Pat. No. 3,440,658 issued on Apr. 22, 1969, and also incorporated herein by reference. In that patent, there is described a combination type antenna including the disc-on-rod antenna in conjunction with a second antenna, the combination of which provides a broad-band, high gain antenna suitable for various types of television applications.

The disc-on-rod type antenna can have the discs spaced from each other over a wide range of values and can also be of a size covering a wide range. However, in my copending application Ser. No. 938,883, filed on Sept. 1, 1978, now abandoned, and also incorporated herein by reference, there is described a disc-on-rod end fire antenna having a particular unique smaller range within the general larger range recited in the aforementioned issued patents in order to provide a significant improvement. In particular, there is employed an end-fire radiator of a length between three times the wavelength and twelve times the wavelength, having a principal axis adapted to be energized by a launcher at its non-radiating end for the transmission of energy of a desired wavelength in the direction of the axis. The electrically active components of the radiator consist of the plurality of substantially identical thin electrically conductive plates spaced between 0.16 and 0.20 times the wavelength along the axis. The plane of the plates are normal to the axis and the difference between the diameter of the plates and the diameter of the supporting rod is greater than 0.23 times the wavelength and less than 0.27 times the wavelength.

In each of the aforementioned types of disc-on-rod antennas, a launcher is utilized to excite the antenna array. Usually, the launcher itself is an elementary antenna of the probe excited open-end waveguide type. More specifically, the launcher generally is formed of a metallic container having a closed back, side walls and an open mounth. A probe, usually formed of a coaxial transmission line, extends into the waveguide container through one of its walls. The probe serves to excite the launcher along the axis of the container. The disc-on-rod end fire radiator is connected along the principal axis of the launcher and is energized by the launcher to the particular energy wavelength. While such elementary antennas are useful as a launcher for the disc-on-rod type antenna, they can actually be utilized independently as a probe excited, open-end waveguide for the transmission of energy by themselves.

In both the disc-on-rod type antenna, as well as the elementary antenna itself, additional electronic circuits are of course required to utilize the antenna for actual reception or transmission. For example, a preamplifier, a down converter, etc. would be needed in conjunction with the antenna in order to utilize it in practice. Such electronic circuits are generally contained within a package in a separate housing positioned in an external location relative to the antenna. Generally, the antenna is mounted on a pole and is subject to wind loading. The electronics package with its own housing is also mounted on the pole. The electronics is connected to the antenna by means of a coaxial cable. In order to eliminate losses, the coaxial connection between the electronic package and the antenna is kept as short as possible. Thus, with two separate housings, specifically the antenna itself, and the separate electronics package housing, there exists additional problems since now there are two housings which are subject to wind load, external environmental damage, excessive weight on the support, packaging and shipping problems, etc.

SUMMARY OF THE INVENTION

Accordingly, it is an object of the present invention to provide an improved antenna which avoids the aforementioned problems of prior art antennas.

Still a further object of the present invention is to provide a probe excited waveguide which avoids the aforementioned problems of prior art devices.

Yet another object of the present invention is to provide a disc-on-rod end-fire antenna excited by a launcher, which avoids the aforementioned problems of prior art devices.

Still another object of the present invention is to provide a probe excited, waveguide which can be used by itself or as a launcher for a disc-on-rod end-fire antenna, and which achieves higher gain than prior devices without an increase in size.

Another object of the present invention is to provide a probe excited open-end waveguide antenna, which can be utilized by itself or as a launcher for a disc-on-rod end-fire antenna, and wherein the electronics package associated with the antenna can be placed within the antenna housing itself.

Yet a further object of the present invention is to provide a probe excited, open-end waveguide which can be used as an antenna by itself or as a launcher for a plate-on-rod end-fire antenna, which comprises a metallic container having an open mouth with a metal structure positioned within the container which improves the gain of the antenna and which can be utilized as a support for the electronics package whereby the electronics can be placed directly within the waveguide container itself.

Briefly, the invention provides for a waveguide formed of a metallic container having an elongated axis, and including at least a back wall, side walls and an open mouth which defines an internal cavity. A probe extends into the cavity for excitation of the waveguide. A metal structure is positioned within the cavity extending in a direction from the back wall to the mouth of the container, and is contained within one half of the volume of the cavity which volume is formed by cutting the container along its elongated axis.

The structure thus formed can be utilized independently as a probe excited open-end waveguide. Alternately, it can be utilized as a launcher at the non-radiating end of a plate-on-rod end-fire antenna. The plate-on-rod antenna is coupled to the mouth of the container such that the probe excited waveguide acts as a launcher for the antenna.

The metal structure placed inside the cavity can be utilized as the housing for an electronics package. In this manner the electronics package is placed directly within the waveguide cavity and a separate housing for the electronics package is eliminated, As a result, the usual problems of wind load on the separate electronics package housing is eliminated. Furthermore, since the need for a second housing for the electronics package is eliminated, there is less weight to the antenna both in connection with shipping the antenna as well as with placing it on a support during use. Additionally, since the electronics package can be placed directly in the metallic container forming the waveguide, the usual losses resulting from coaxial cables connecting the antenna to the electronics package are thereby completely eliminated.

In addition to obtaining the benefit of maintaining the electronics package directly within the waveguide, a most unusual and unexpected result occurs. It would have been expected that the benefit of maintaining the electronics package of the waveguide housing would have been at the expense of the antenna gain. It might have been hypothesized that the electronics package would interfere with the energy transmitted by the waveguide so as to cause back radiation in the opposite direction to thereby reduce the gain, or, at the very least, to introduce complex modes of transmission thereby reducing the launching efficiency of the waveguide.

On the contrary, instead of having the electronics package and the metal structure deteriorate the efficiency of the probe excited open-end waveguide, an unusual result occurs in that a somewhat higher gain is actually achieved from the antenna, without increasing its size. This higher gain is achieved by the presence of the metal structure itself positioned within the waveguide, whether the electronics package is included or not. Such improvement in gain occurs both when the probe excited, open-end waveguide is used as an elementary antenna itself, or more especially when used as a launcher for a disc-on-rod radiator.

Accordingly, the present invention provides for such probe excited, open-end waveguide, having a metal plate container within the waveguide cavity as aforedescribed, in order to achieve the improved gain. As mentioned, the electronics package can also be included within the container or under the plate in order to eliminate the necessity for a separate housing for the electronics package. An improved exciting probe is also provided which provides the benefits of a large probe while maintaining a low mass.

The aforementioned objects, features and advantages of the invention, will, in part, be pointed out with particularity, and will, in part, become obvious from the following more detailed description of the invention taken in conjunction with the accompanying drawing, which form an integral part thereof.

BRIEF DESCRIPTION OF THE DRAWING

In the drawings.

In the various figures of the drawing, like reference characters designate like parts.

DESCRIPTION OF THE PREFERRED EMBODIMENT

Figure 1:
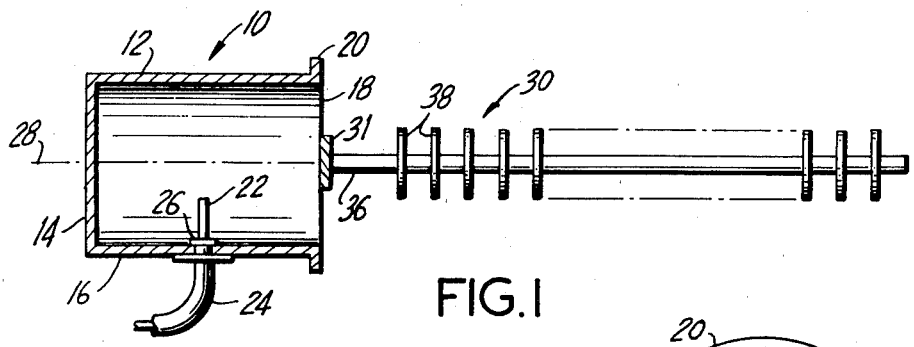
FIG. 1 is a sectional side elevational view of the disc-on-rod antenna of the prior art, using a waveguide launcher.
Figure 2:
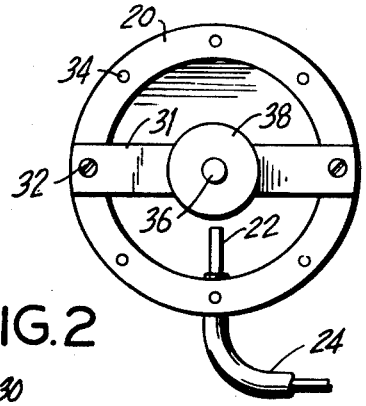
FIG. 2 is an end view of the antenna described in FIG. 1.
Figure 3:
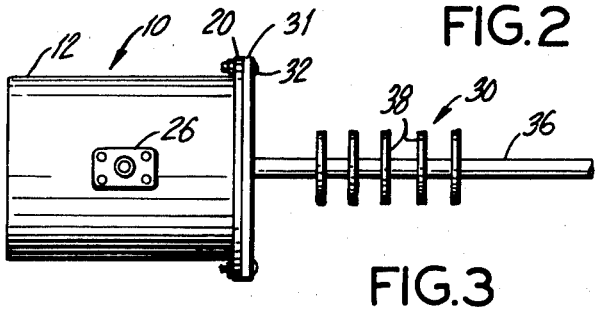
FIG. 3 is a bottom plan view of the antenna shown in FIG. 1.

Referring now to FIGS 1–3 there is shown a disc-on-rod type antenna of the prior art, as was described in the aforementioned patents and pending application.

More particularly, there is shown a waveguide section 10 which includes a cylindrical container 12 having a closed back 14, sidewalls 16, and an open mouth 18. A peripheral lip 20 is contained around the open mouth. The waveguide section 10 is excited by means of a probe 22 formed from the center portion of a coaxial line 24 connected through a side wall 16 by means of a standard coupling connector 26. The coaxial cable extends from the waveguide section 10 to appropriate electronic circuitry. The waveguide section 10 propagates a signal which is polarized in a direction parallel to the probe. As shown with a vertical probe, a vertically polarized signal would result along the axis 28.

The waveguide section 10 can be utilized independently as an elementary antenna, or it can be utilized as the launcher for a disc-on-rod radiator. As shown, a disc-on-rod array 30 is connected to the waveguide section 10 by means of a support member 31 which is a metal bar secured to the peripheral lip 20 by means of nuts and bolts 32 positioned in appropriate ones of the many holes 34 provided in the peripheral lip 20.

The connector support member 31 is positioned transverse to the probe 22 so as not to interfere with the signal being transmitted. If it would be desired to transmit a horizontally polarized signal, the probe would be oriented to 90° from the position shown, and more particularly in a horizontal direction, and the support bar 31 would be placed vertically. If support member 31 were non-metallic any orientation would be acceptable.

Extending from the support bar 31 is a disc-on-rod radiator which comprises the axial rod 36 and transversely spaced apart discs 38. Although one rod section is shown, it is understood that each rod could terminate in a coupling adapted to receive additional successive sections.

As was explained in the aforementioned pending applications the disc should have a diameter greater than $\lambda/4$ and less than $\lambda/2$ and a spacing between $\lambda/8$ and $\lambda/2$. However, as described in the aforementioned pending application by restricting the disc spacing and the diameter of the discs and rod to a specific smaller range, there is a significant improvement obtained. In particular, where the energy is of a wavelength $\lambda$, the end fire radiator is between a length of $3\lambda$ and $12\lambda$ having a principal axis adapted to be energized by the launcher at its non radiating end for the transmission of energy of a desired wavelength in the direction of the axis. The thin electrical conductive discs are placed between $0.16\lambda$ and $0.2\lambda$ apart along the axis with the plane of the disc normal to the axis. The difference in diameters between the discs and the rod is greater than $0.23\lambda$ and less than $0.27\lambda$.

The electronics associated with the antenna as described would generally be contained in a separate housing spaced from the antenna. For example, the preamplifier, and other electronics, would all be placed separately from the antenna.

Generally, the disc-on-rod type antenna is mounted by means of a bracket to a supporting mast generally on the roof of a building. The antenna is therefore subject to heavy winds and experiences detrimental environmental conditions. When the electronic circuitry is contained in a separate housing apart from the antenna, it is often mounted separately from the antenna on the same mast. Although the electronics could, of course, be brought inside the building and therefore removed from the detrimental environmental conditions, this is generally avoided since that would require a long length of cable from the antenna to the electronics which could result in great electrical losses. Thus, it is generally preferred to maintain the electronics as close to the antenna as possible in order to avoid such electrical losses. However, it is then necessary to provide a suitable housing for the electronics package so that it too can sustain the wind load and other detrimental environmental conditions. Nevertheless, some electrical loss still exists since the electronics is nevertheless separate from the antenna.

Another problem with the existing prior art type of antennas concerns the ability to achieve high gain. It is normally accepted that in order to achieve higher gain, larger antenna is required. While many cases will permit large dimension devices, in numerous applications the size is limited by the space available, the cost of the equipment, the wind load tolerable and other factors.

It has been discovered that it is possible to achieve higher gain from the aforementioned type of antenna without increasing its size. In addition, a region is created directly within the antenna itself which may be used to contain the electronic circuitry. As a result, there is avoided the need for having an electronics package separate from the antenna, necessitating a separate housing. Because only one housing in needed, the wind load is reduced, the transmission loss is reduced, the size of the antenna space is reduced wince the electronics is directly contained within the antenna itself, and surprisingly, the gain of the antenna itself is increased.

These benefits have been found to result from the inclusion of a metal structure within the waveguide portion. The only restructions on this additional included metal structure are, that it must be spaced within at most, one half of the volume of the waveguide cavity. This volume being formed by cutting the waveguide cavity along its longitudinal axis. The probe which is utilized for exciting the waveguide section extends from the metal structure into the other half of the cavity and across the longitudinal axis, for excitation of the waveguide itself.

Figure 4:
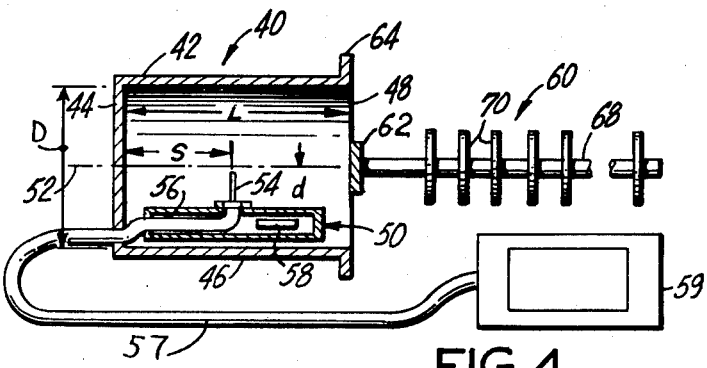
FIG. 4 is a sectional side elevational view of the disc-on-rod type antenna of the present invention, employing the improved probe excited open-end waveguide.
Figure 5:
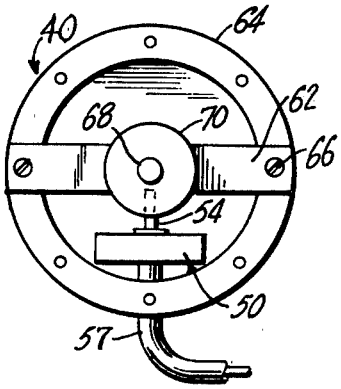
FIG. 5 is an end view of the antenna shown in FIG. 4.
Figure 6:
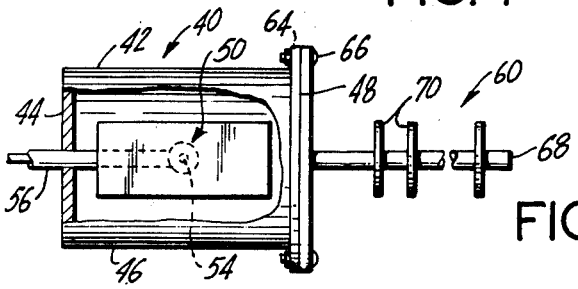
FIG. 6 is a bottom view of the antenna shown in FIG. 4, with part broken away.

More specifically, referring now to FIGS. 4 to 6, there is shown a waveguide section 40 formed of a cylindrical container 42, having a back wall 44, side walls 46, and an open mouth 48. Placed within the cylindrical container is a metal structure shown generally as 50. The metal structure is shown as a rectangular hollow metal box although it may be a simple metal plate. It is shown spaced from the side walls 46 and extends in a direction from the back wall 44 to the mouth 48. The metal structure is shown as being parallel to the axis of the antenna 52 and spaced below the axis by a distance d. Thus, the metal structure is contained within, at most, one half of the volume of the waveguide cavity and does not cross the center axis 52 of the container.

The probe 54 extends upwardly from and at right angles to the surface of the metal structure. The probe, which is an extension of the center conductor of the coaxial cable 57, may extend into the remainder of the container not having the metal structure. An electrical cable 56 shown as coaxial, passes within the metal structure toward the rear wall 44 of the container and leaves the container proximate the rear wall 44 and continues as the cable 57. Although it is shown as leaving directly from the rear wall, it could as well leave from the point adjacent thereto. However, since the metallic structure 50 must be isolated from the side walls, the probe can not be electrically connected to the side walls.

Also included within the metal structure 50, if it is hollow may be an electronics package, shown schematically at 58. Such electronics package 58 could include the usual circuitry which would generally be placed outside of the antenna, such as the transmitter, preamplifier, down converter, etc. The input or output signal from device 58 can be fed to a utilization device 59 such as a television set, video recorder, or a TV camera. The cable 56 and probe 54 would then be connected to the electronics 58 on both the output and the input sides respectively, as will be discussed more fully hereinafter.

Connected to the waveguide section 40 is the disc-on-rod radiator 60 which is coupled by means of the support bar 62 connected onto the peripheral lip 64 by means of the nuts and bolts 66. The disc-on-rod radiator includes the center axial rod 68 supporting the spaced apart discs 70. The preferred spacing of the discs on the rod as well as the range of the diameter sizes are all as described before.

The waveguide section 40 is generally of a length L, and a major dimension or diameter D which is between $\lambda/2$ and $\lambda$. As is well known, when D is less than approximately $\lambda/2$ cutoff occurs, and with D greater than approximately $\lambda$ higher than the dominant mode can propagate. The distance between the probe 54 and the back wall is shown as distance S, and is well known to be optimally between λ/8 and λ/2 for best impedance match to the coaxial line. Thus, the length of the metal structure must be between the values S and L.

This length of metal structure extends in a direction between the back wall and the mouth. The metal structure can touch the back wall, if desired, and accordingly the back wall can be used for support of the metal structure holding it in cantilevered fashion within the metallic container. The metal structure should not extend past the mouth of the container. However, it should not touch the side walls of the waveguide container for best results. Preferably it should clear it by at least a distance 0.01λ.

In the prior art, waveguides have been formed with metal structures in them. Such waveguides are well known as ridged waveguides. However, in such ridged waveguides, the internal metal structure must be in electrical contact with the side walls along the entire length. Furthermore, the inclusion of the metal structure to form a ridged waveguide is such as to modify the transmission signal so as to change the wavelength in the waveguide. In the present situation, the metal structure should not touch the side walls. Furthermore, it is found that it does not change the waveguide wavelength. Thus, the present metal structure does not perform in any manner like a ridged waveguide.

By the inclusion of the metal structure it would have been assumed that the gain of the antenna would, if anything be reduced since the dominant mode structure would be disturbed and the field would therefore not exist in the aperture region in the optimum form for radiation. However, it was discovered that the presence of the metal structure actually increased the gain. Thus, not only is there a benefit obtained in that there is provided room in the antenna for direct inclusion of the electronics package, but additionally, a gain occurs in the antenna itself.

It has further been found that the metal structure need not be a closed container, but can actually be reduced to a single plate. Thus, the electronics package, as well as the coaxial transmission line, can be placed under the plate and still obtain the aforementioned benefits. Even utilizing this simple plate, the electronics is still isolated from the radiating portion by the metal plate, since it is in a region beyond cutoff to the lowest waveguide mode. If a plate is used, the outer conductor of coaxial line 56 should be in contact with the plate.

Additionally, both the shape of the waveguide section as well as that of the metal structure need not be specifically as shown. The waveguide container can be of numerous shapes, not necessarily a circular cylinder, but e.g. a square or rectangular cylinder could be used. Furthermore, the metal structure can also be of numerous shapes, and in fact need not even be flat.

In a specific embodiment, a circular waveguide launcher of prior art construction was utilized of a size approximately 4 inches long by approximately 4 inches in diameter and a disc-on-rod radiator of about 35 inches long was provided with 32 discs, each 1¾ inches in diameter and 1 1/16 inches spaced apart. The diameter of the support rod was ⅜th inches. Working at a frequency of 2153 mHZ, it has been found that the gain was about 17¾ db above isotropic when the waveguide propagates the TE 11 mode excited by a coaxial line probe extending from the side of the waveguide about 2 inches from the closed end. This gain value was considered about maximum obtainable in the prior art for this size antenna at this frequency.

In accordance with this invention a metal structure was placed in the container spaced from the side walls. By placing the metal structure in the container, and with the probe extending from the surface of the metal structure into the container, the gain value was increased by at least ½ db to 18¼ db above isotropic. Furthermore, in addition to having the increased gain, a location was found directly inside the antenna cavity for an electronics package.

The exact reason why the metal structure improves the gain is not fully understood. It is noted that the metal structure and the cylinder, in addition to allowing the waveguide mode also forms a coaxial transmission system with the inner conductor being the metal structure which is eccentrically located with respect to the axis of the waveguide. Both systems are excited by another coaxial system, within or in contact with the metal structure by means of the probe. It is difficult to analyze this complex structure, especially as a radiating one. However, the measured result indicates an improvement in radiation efficiency. Furthermore, an internal housing is found for the electronics package which isolates the electronics from the radiating structure.

Not only was an increase in gain achieved when utilizing this structure as a launcher for a disc-on-rod radiator, an improvement in the gain was also found when utilizing the waveguide container itself as an elementary antenna without the disc-on-rod radiator. Although the gain improvement was less than occurred when utilizing it with the disc-on-rod radiator, nevertheless, an unexpected gain improvement did occur, compared to a predicted reduction, if anything. Furthermore, the benefit of providing the electronics directly in the antenna was still obtained.

Figure 7:
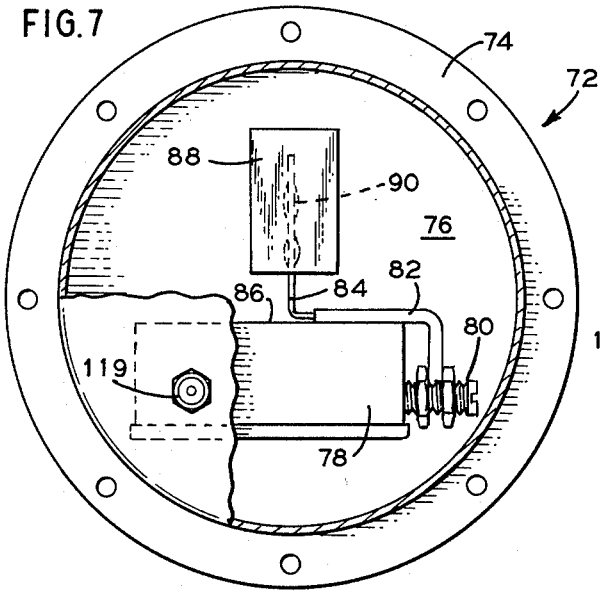
FIG. 7 is a partially sectioned rear elevational view of an antenna containing a downconverter and showing an improved exciting probe.
Figure 9:
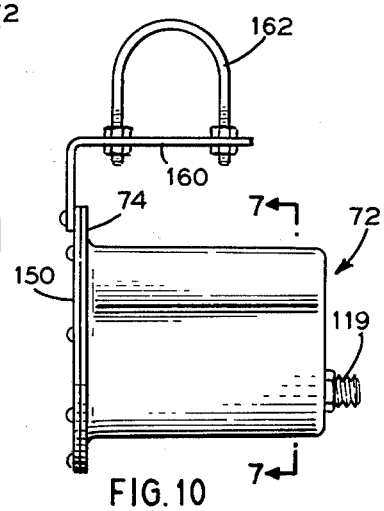
FIG. 9 is a side elevational view of the apparatus of FIG. 7.
Figure 8:
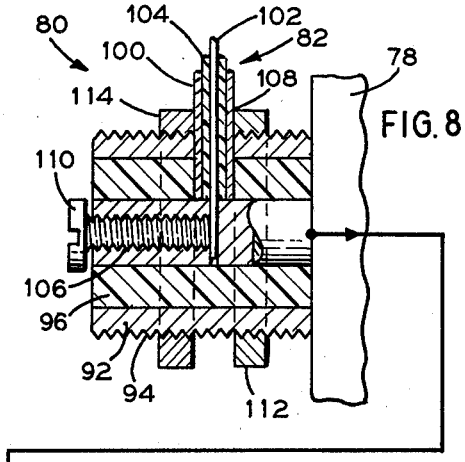
FIG. 8 is a sectional view taken through the coaxial connector of FIG. 7, and showing an improved connector to the exciting probe, and a block diagram of a typical downconverter and utilization circuit.

Referring now to FIG. 7, 8 and 9, there is shown a preferred embodiment of the exciting probe utilized for excitation of the waveguide, as well as a unique interconnection between the exciting probe and the metal structure. In FIG. 7 the waveguide container is shown generally at 72 and includes the peripheral lip 74 surrounding the cylindrical container 76 which forms the antenna cavity. Located within the antenna cavity 76 is the metal structure 78 as was previously described. The exciting probe is connected by means of a coaxial connector 80 which is coupled to the side of the metal structure 78. A coaxial line 82 is electrically and mechanically connected to the coaxial connector 80. The center conductor 84 of the coaxial line 82 is bent upwardly from the top surface 86 of the metal structure 78 and is connected to a lightweight metal member 88, hereinafter referred to as a flag. The center connector 84 is shown interconnected to the flag by means of a solder joint 90. The flag is shown as being of rectangular configuration and is typically ½"×¾" and about 0.010" thick.

Generally, it is desired to have a probe of this large size for good impedance matching. On the other hand it is preferable to make it small in order to avoid detrimental effects due to shaking, dropping, and other means of damage by impact. However, by using a probe larger than a thin wire, results the problem of increased mass of the probe. By soldering the light weight flag onto the center conductor, we achieve the benefit of having the larger probe and at the same time avoid the possible damage during shipment and installation from shock caused by extra mass usually involved with a larger probe. This is achieved by using a lightweight flat metal plate soldered onto the wire. As a result, the low mass is not subject to handling shock which would normally bend the small diameter wire center conductor, it it had to support a heavy mass. At the same time, the flag is suitably scaled to provide the necessary electrical requirements as needed for the proper probe to provide the needed bandwidth.

In order to interconnect the coaxial line 82, to the coaxial connector 80, a unique interconnecting arrangement is also provided. As can best be seen in FIG. 8, the coaxial connector 80 is shown enlarged and connected to the metal structure 78. The coaxial connector typically includes outer conductor 92 having an external thread thereabout 94 for coupling to another line. Inwardly of the outer conductor 92 is the insulating layer 96. At the center of the coaxial connector is the inner conductor 98.

The coaxial line 82 which is used for the probe includes its outer conductor 100, center conductor 102 and separating insulating layer 104.

In order to interconnect the coaxial line 82 to the coaxial connector 80, the inner conductor 98 of the connector 80 is drilled at least a portion therethrough to form an axial opening 106. A radial opening 108 is formed through a side of coaxial connector. The coaxial line 82 is then inserted through the radial opening 108 so that its center conductor 104 extends into an axial hole drilled out within the inner conductor 98. A screw lock 110 is then inserted into the axial opening 106 and serves as a set screw to hold the center conductor 104 within the inner conductor area of the coaxial connector 80. Suitable locking nuts 112 and a locking washer 114 are used to hold the coaxial line 82 securely to the coaxial connector 80.

The antenna as described together with suitable electronics package contained within the antenna can be used in an MDS system, either as the transmitting system or the receiving antenna. For example, when utilized in a receiving system, various electronic circuits would be utilized, as shown in FIG. 8. Specifically, in areas with sources of interferring signals such as radar installations, following the antenna there may be included a preselector (not shown) This would then be followed by a preamplifier 12 whose purpose is to compensate for the mixer loss in the down converter and to make up for path loss at distant receiving locations. A well designed preamplifier will have a low noise figure and will be sharply tuned to the incoming MDS frequency. This sharp tuning will help keep unwanted signals from entering the mixer 122 and producing unwanted products in the down converter output. The mixer 122 receives a signal from oscillator 126.

Following down converter there is generally included an IF amplifier 128 whose purpose is to boost the signal from the mixer. This IF amplifier produces the necessary output to the TV receiver 130. An output coaxial connector 119 permits attachment of a coaxial cable.

The power supply 132 utilized the standard household 120V AC input rectifies and provides a voltage controlled 24V to the down converter. A control box 140 generally located near the television set has circuitry which feeds DC power up the cable from the down converter and splits out the RF from the down converter. The power supply is generally well regulated and filtered to prevent overloads, brownouts, and noise from effecting the performance of the down-converter.

In most cases, a matching transformer is utilized prior to the TV receiver.

The preselector is not always necessary but is advisable to avoid interference. It is formed of a sharply tuned band pass filter that allows the MDS signal to enter the down converter but attenuates all other frequencies.

Figure 10:
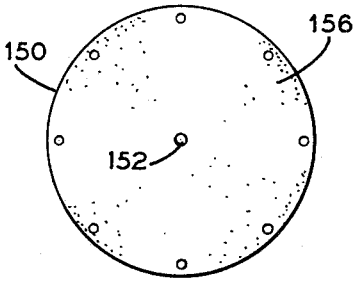
FIGS. 10 and 11 are front and rear elevational views of a radome utilized in the apparatus.
Figure 11:
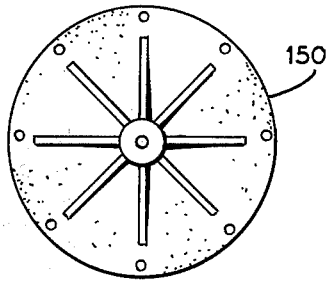
Figure 11:
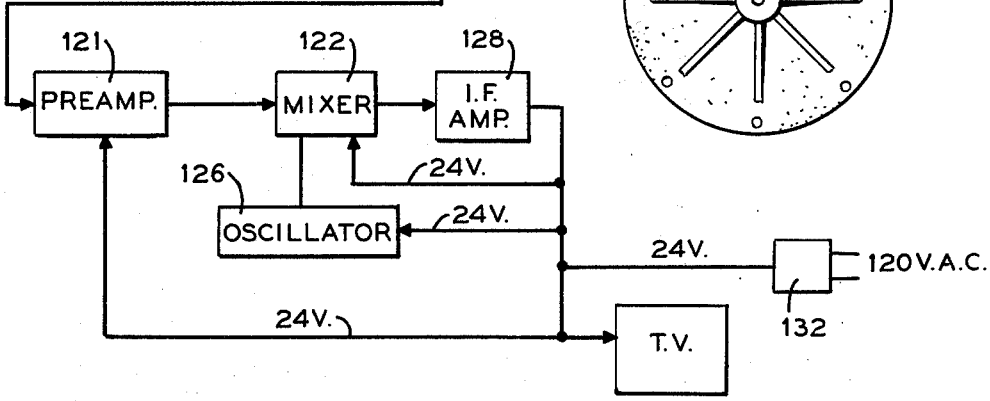

The metal cross-bar 62 may be replaced by a glass-filled synthetic resin plate 150, shown in FIGS. 9, 10 and 11. A threaded bore 152 may be provided to receive the threaded end of the disc-on-rod assembly.

Stiffening ribs 154 permit use of a relatively thin plate 156 to minimize transmission losses. The plate may be secured to the cavity by conventional fasteners such as nuts and bolts. Bracket 160 and U bolt 162 are utilized for mounting the assembly to a mast.

Although a particular receiving system has been described, it is understood that a transmitting system could also be included where an up converter would be placed directly within the housing of the waveguide.

There has been disclosed heretofore the best embodiments of the present invention. However, it is to be understood that various changes and modifications may be made thereto without departing from the spirit of the invention.

I claim:

1. A probe excited waveguide, comprising:

a metallic container having an elongated axis, and including at least a back wall, side walls, and an open mouth which define an internal cavity;

a metal structure positioned within the container extending in a direction between the back wall and the mouth of the container, spaced from the side walls of the container and contained within at most one half of the volume of the cavity, said half volume being formed by cutting the container along its elongated axis;

a probe extending from the metal structure into the remaining portion of the cavity for excitation of the waveguide;

and further comprising a plate-on-rod end-fire radiator element coupled to the mouth of the container such that said probe excited wave acts as a launcher at the non-radiating end of the radiator element.

2. A waveguide as in claim 1, wherein said probe comprises the center conductor of a coaxial line, and a lightweight, flat metal plate electrically coupled to said center conductor.

3. A waveguide as in claim 2, wherein the coaxial line is coupled to a coaxial connector on said metal structure, an aperture radially formed through a side of the coaxial connector through which the center conductor is inserted, a hole axially formed through the inner conductor of the coaxial connector, and a set screw inserted into said axial hole to lock the center connector to the inner conductor of the coaxial connector.

4. A waveguide as in claim 1, and further comprising a support member extending across the mouth of the container and axially supporting said radiator element from said container.

5. A waveguide as in claim 4, wherein said support member is conductive and is positioned perpendicular to the probe.

6. A waveguide as in claim 1, wherein said plate-on-rod radiator element has an axial conductive support rod, having a length of between 3λ and 12λ, and a plurality of thin plates spaced between 0.16λ and 0.20λ along said rod, each of said plates lying in a plane containing the electric vector of the signal radiated by said launcher and the difference between the diameter of the plates and the diameter of the rod is greater than 0.23λ and less than 0.27λ.

7. A waveguide as in claim 6, wherein said container is a circular waveguide approximately 4 inches long by approximately 4 inches in diameter, said plate-on-rod radiator is approximately 35 inches long, having 32 discs each approximately $1\frac{3}{4}$ inches in diameter with a spacing between the plates of approximately 1 1/16 inches, said rod having a diameter of about $\frac{3}{8}$th inch, and wherein the frequency of the transmitted signal is 2 GHz.

8. A plate-on-rod end fire antenna comprising a launcher and an end fire radiator having a principal axis adapted to be energized by the launcher at the non-radiating end of the radiator for the transmission of signal energy of wavelength λ in the direction of the axis, said launcher comprising a container, a metal structure positioned within the container spaced from the side walls of the container and not intersecting said axis, and an exciting probe extending from the metal structure into the container.

9. An antenna as in claim 8, wherein the diameter D of the waveguide is between λ/2 and λ, the probe is spaced from the back wall a distance S of between λ/8 and λ/2, λ being the wavelength of the transmitted energy, and wherein the metal structure extends a length of between S and the length L of the waveguide.

10. An antenna as in claim 8, wherein the probe is coupled to a coaxial feed line which enters the container at a point proximate its back wall.

11. An antenna as in claim 8, wherein the end fire radiator has an axial conductive support rod having a length of between 3λ and 12λ, and a plurality of thin plates spaced between 0.16λ and 0.20λ along the rod, said plate having a dimension in a plane containing the electric vector of the signal radiated by the launcher, and the distance between the diameter of the plates and the diameter of the rod is greater than 0.23λ and less than 0.27λ.

12. An antenna as in claim 8, wherein said container is a circular waveguide launcher approximately 4 inches long by approximately 4 inches in diameter, said plate-on-rod radiator is approximately 35 inches long, having 32 discs each approximately $1\frac{3}{4}$ inches in diameter with a spacing between plates of approximately 1 1/16th inches, said rod having a diameter of approximately $\frac{3}{8}$th inch wherein the frequency is about 2 GHz.

13. An antenna as in claim 8, wherein said metal structure is a plate.

14. An antenna as in claim 8, wherein said probe is a coaxial line having its outer conductor connected to the metal plate and the center conductor passing through the plate.

15. An antenna as in claim 8, wherein the probe extends across the axis.

* * * * *